United States Patent [19]

Langley, Jr. et al.

[11] Patent Number: 4,942,714

[45] Date of Patent: Jul. 24, 1990

[54] REBAR AND BEAM BOLSTER, SLAB AND BEAM BOLSTER UPPER

[75] Inventors: Marshall E. Langley, Jr.; Robert C. Sims; Richard M. Sims; James N. Turek, all of Lexington, Ky.

[73] Assignee: Turek Marketing International, Lexington, Ky.

[21] Appl. No.: 308,953

[22] Filed: Feb. 6, 1989

Related U.S. Application Data

[63] Continuation-in-part of Ser. No. 152,701, Feb. 5, 1988, abandoned.

[51] Int. Cl.[5] ..... E04C 5/20

[52] U.S. Cl. ..... 52/687

[58] Field of Search ..... 52/677, 687, 678–686; 403/331, 354, 381, 245, 263

[56] References Cited

U.S. PATENT DOCUMENTS

| | | | |
|---|---|---|---|
| 824,595 | 6/1906 | Scofield | 52/687 |
| 2,106,576 | 1/1938 | Reiland | 52/688 |
| 2,116,584 | 5/1938 | Shelby | 403/381 |
| 3,233,383 | 2/1966 | Salm | 52/687 |
| 3,512,331 | 5/1970 | Palmer | 52/687 |
| 3,529,392 | 9/1970 | Adams | 52/687 |
| 3,839,838 | 10/1974 | Vigh | 52/740 X |

FOREIGN PATENT DOCUMENTS

| | | | |
|---|---|---|---|
| 176815 | 4/1986 | European Pat. Off. | 52/677 |
| 2509459 | 9/1976 | France | 52/687 |
| 363827 | 10/1938 | Italy | 52/584 |

*Primary Examiner*—David A. Scherbel
*Assistant Examiner*—Jerrold D. Johnson
*Attorney, Agent, or Firm*—King & Schickli

[57] ABSTRACT

A bolster is constructed of non-biodegradable material. The bolster includes an elongated support member and legs for holding the support member in an upright position. An assembly is also provided to serially connect the bolsters together. More specifically, one end of the bolster includes a male connector and the opposite end a female connector. The non-biodegradable material is impervious to water and both shatter-resistant and sag-resistant within a temperature range between 220° and −40° F. The material also has a flex modulus of between 200,000 and 1,500,000. Preferably, the material also bonds with concrete so as to form a substantially watertight seal.

17 Claims, 4 Drawing Sheets

REBAR AND BEAM BOLSTER, SLAB AND BEAM BOLSTER UPPER

This application is a continuation-in-part of application, Ser. No. 152,701, filed Feb. 5, 1988, now abandoned.

Technical Field

The present invention relates generally to the construction field and, more particularly, to a bolster that may, for example, be utilized to support metal rebar or beams above the floor of a form prior to pouring concrete. Such a bolster may be utilized in any general construction involving concrete.

Background of the Invention

It is well known in the art to build a form of wood, metal or other sheet material to act as a mold into which concrete is poured and then allowed to set. It is also well known that the strength of the resulting concrete slab may be greatly increased by pouring the concrete around reinforcing steel, known as rebar, that may be positioned within the form prior to adding the concrete.

For best results and maximum strength, the concrete surrounds and fully encases the reinforcing steel. Where heavy reinforcing steel is utilized, the steel should be supported above the bottom wall or floor of the form. This can be accomplished by utilizing bolsters.

Bolsters are relatively lightweight frame members that are positioned at spaced intervals on the floor of the form. Each bolster includes a rebar or beam supporting surface that is spaced from the form floor. After placing the necessary bolsters in position within the form, the rebar is positioned extending between and across the support surfaces of the bolsters. The concrete that is then poured into the form can flow around the rebar even into the space between the rebar and the form floor. Thus, the rebar is fully surrounded and encased by the concrete as desired to provide maximum strength to the concrete slab.

For many years, the road construction industry has used bolsters constructed from metal wire stock. Such bolsters are relatively inexpensive to produce. They also provide sufficient strength to support reinforcing steel in proper position during the pouring and setting of concrete. Recent studies have, however, identified a significant shortcoming to their use. More specifically, metal wire bolsters promote spalling of the concrete.

In spalling, pieces of concrete and in some instances, large chunks break away from the main concrete slab. This is a particularly dangerous safety condition on, for example, roadway bridges. Spalling not only reduces the integrity of the structure but if the condition goes unchecked, it can even lead to a bridge collapse. There, of course, is also the added danger that pieces of concrete falling from a bridge structure could land on vehicles or individuals passing under the bridge.

Research has shown that the causes of spalling are water related. Once the concrete slab sets, the form is removed leaving the legs of the bolster that previously rested upon the bottom wall of the form exposed. Air and moisture seeping around and under the slab cause the exposed legs of a metal wire bolster to corrode and rust over time. Moisture also has a tendency to be drawn upwardly into the slab by capillary action along the interface between the metal bolster and the concrete In fact, the moisture may even be drawn deep into the formation along the rebar. As the bolster and the rebar rust, gas is released. Eventually, sufficient gaseous pressure may build up within the slab so as to cause pieces of concrete to actually be exploded from the main slab.

The spalling action may be further accelerated and accentuated by low temperatures. More specifically, subfreezing temperatures cause water trapped within the concrete slab in the area of the bolster and rebar interfaces with the concrete to freeze. As the water freezes, it expands exerting tremendous forces on the concrete that can cause pieces of the concrete to break away from the slab.

Several different approaches have been utilized to date to address and overcome the spalling problem. Bolsters constructed from galvanized wire and even stainless steel are available. While these do substantially reduce the problems of spalling from the rusting of a bolster, they do not represent a fully acceptable solution for a number of reasons. One is that they are relatively expensive to produce. Another is that they still do not bond well with the concrete. Thus, water can still be drawn by capillary action deep into the formation along the interface between the bolster and the concrete. This water can move up along the bolster to the rebar and thus still cause rusting problems that lead to spalling. The water, of course, can also freeze in the formation and thereby cause spalling in this manner as well.

Another alternative approach has been to utilize bolsters constructed of metal wire stock dipped in and coated with epoxy. While the epoxy coating does prevent the legs of the bolsters from rusting, the coating is, unfortunately, prone to chipping either during simple handling of the bolsters or during removal of the form after the concrete sets. Rusting of the resulting exposed metal surface is, of course, likely. In addition, the epoxy coating does not bond with the concrete. Thus, water can still enter by capillary action into the formation and cause spalling as discussed above. A need is, therefore, identified for a new and improved bolster.

Summary of the Invention

Accordingly, it is a primary object of the present invention to provide a bolster for supporting various types of reinforcing material such as steel rebar within a form overcoming the above-described limitations and disadvantages of the prior art.

Another object of the present invention is to provide a relatively lightweight and easy-to-handle bolster that is also relatively inexpensive to produce.

An additional object of the present invention is to provide a lightweight, relatively stackable bolster that is less bulky so as to substantially reduce shipping costs.

Still another object of the present invention is to provide a bolster that may be easily produced in various size increments.

Yet another object of the present invention is to provide bolsters that may be positively connected together in direct alignment by simply snapping together.

Still another object of the present invention is to provide a bolster that: (1) is non-biodegradable; (2) exclusively includes rounded corners to prevent formation of stress fractures in the concrete slab and (3) bonds with the concrete so as to substantially prevent water from seeping between the bolster and the concrete and thereby prevent spalling.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects and in accordance with the purposes of the present invention as described herein, a bolster for supporting reinforcing steel such as beams and rebar includes an elongate support member having an upper surface for supporting the reinforcing steel. Legs extend downwardly from the support surface to hold the support member in an upright position. Both the support member and legs are constructed from a non-biodegradable material. Thus, advantageously, the spalling that has directly resulted in prior art designs from the rusting of a bolster is completely avoided. In addition, all corners of the bolster including the support member and the legs are rounded. In this manner stress concentrations in the concrete formation are minimized and stress fractures of the concrete slab are substantially avoided.

Preferably, the legs extend within a plane running substantially perpendicular to the elongate support member. In this way, the legs provide a solid base to prevent the bolsters from tipping over on the side as the reinforcing steel is positioned to extend across and between the bolsters resting on the floor of a form.

A structure is also provided for positively connecting bolsters together in series. In this way, the bolsters may be positioned in direct alignment so as to extend completely across a form, such as for a roadway bed of a bridge. More particularly, each bolster includes a male connector at one end and a cooperating female connector at the opposite end. The male connector may be a pin or a snap-in plate with locking ridges. The female connector may, for example, be a cooperating pin receiving aperture or a pair of resilient latching plates designed to engage the locking ridges on the snap-in plate.

The non-biodegradable material utilized in constructing the bolster is water resistant. Thus, water cannot penetrate or seep through the bolster material into the concrete slab. In addition, the non-biodegradable material is shatter-resistant and sag-resistant within a temperature range between at least approximately 220° and −40° F. The material can also support a concentrated load of between 60 and 400 psi.

The bolster also has a flex modulus of between 200,000 and 1,500,000. Preferably, the bolster is formed from a material that bonds with concrete so as to form a seal that substantially prevents penetration of water into the concrete slab along the interface between the bolster and the concrete. Advantageously, this bonding or sealing of the interface prevents water from being drawn upwardly into the concrete slab to the rebar. As a result, spalling caused by either the freezing of water deep within the concrete slab or the rusting of the rebar superstructure is avoided. Consequently, the integrity and, therefore, the safety of the structure is maintained and maintenance costs are greatly reduced.

In order to achieve this end, the bolster may be constructed of a man-made resin. Example materials for the construction of the bolster of the present invention include ABS plastic, polycarbonate, polybutyleneterephthalate, polyphenylene oxide and any mixtures thereof.

Still other objects of the present invention will become readily apparent to those skilled in this art from the following description wherein there is shown and described a preferred embodiment of this invention, simply by way of illustration of one of the modes and alternative embodiments best suited to carry out the invention. As it will be realized, the invention is capable of other different embodiments, and its several details are capable of modifications in various, obvious aspects all without departing from the invention. Accordingly, the drawing and descriptions will be regarded as illustrative in nature and not as restrictive.

Brief Description of the Drawing

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

Detailed Description of the Invention

Figure 1:
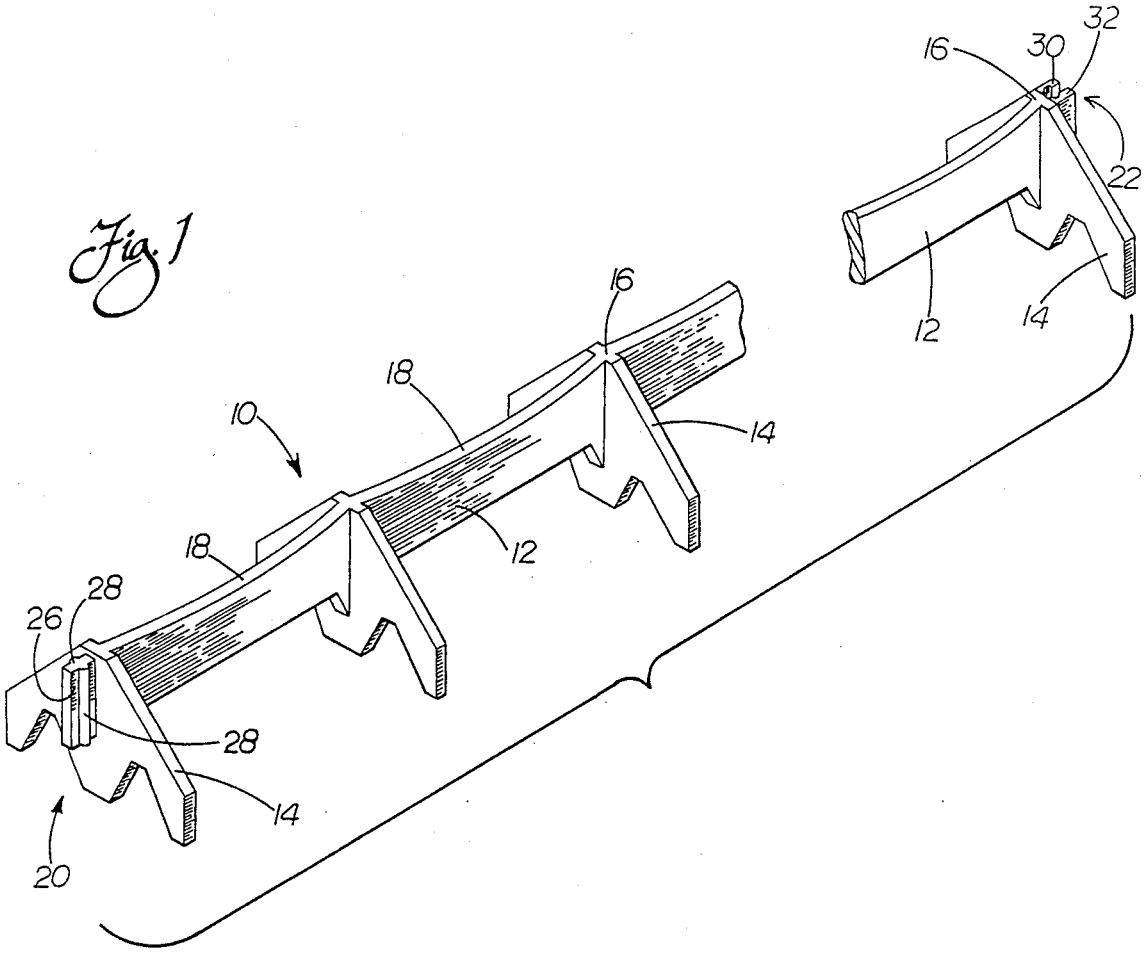
FIG. 1 is a perspective view of one embodiment of the bolster of the present invention.
Figure 5:
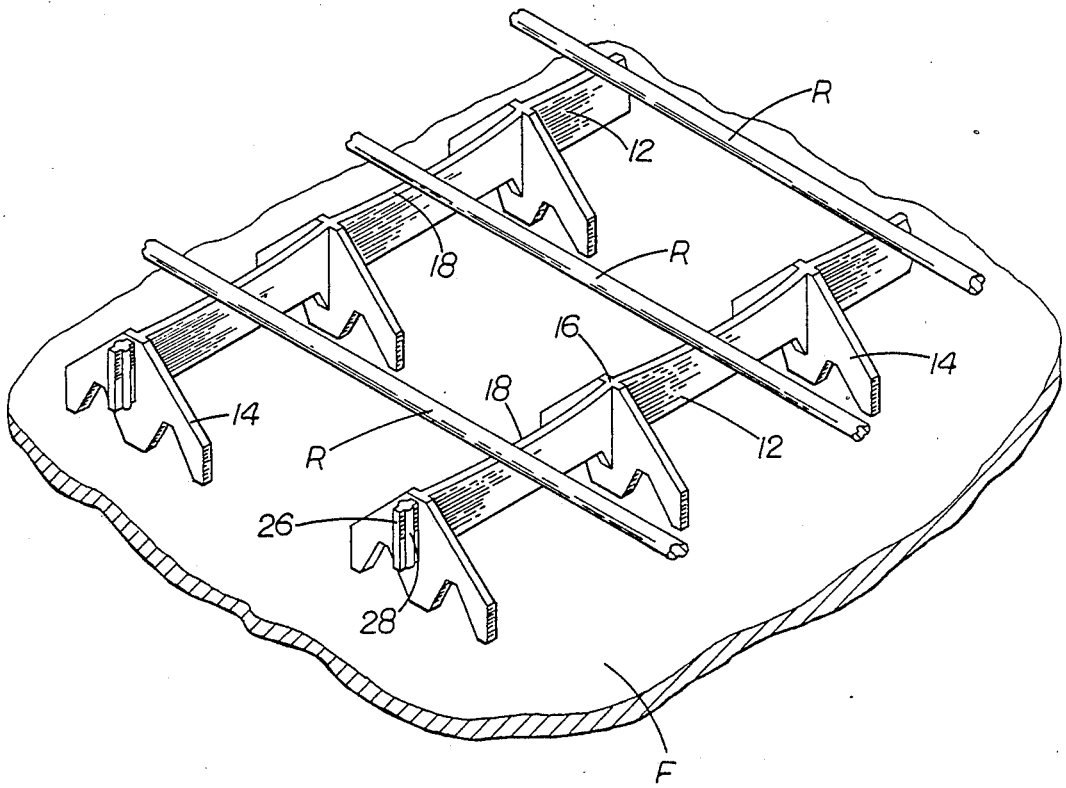
FIG. 5 is a perspective view showing bolsters as shown in FIG. 1 sitting on the floor of a form with rebar resting between and across the bolsters.

Reference is now made to FIG. 1 showing one embodiment of the bolster 10 of the present invention for supporting reinforcing steel such as beams and/or rebar. The bolster 10 includes an elongated, planar support member 12. Legs 14 hold the support member 12 in an upright position when, for example, positioned on the bottom wall of a form F as shown in FIG. 5.

The support member 12 includes an upper surface 16 for supporting the reinforcing steel above the bottom of the form. As shown in FIGS. 1 and 5, the surface 16 may include scallops 18. The sloping surface of the scallops 18 serves to resist the tendency of rebar to roll together, thereby maintaining the desired spacing between the individual pieces of rebar R. The size and positioning of the scallops 18 may, of course, be varied depending on the desired spacing of the rebar.

Figure 4:
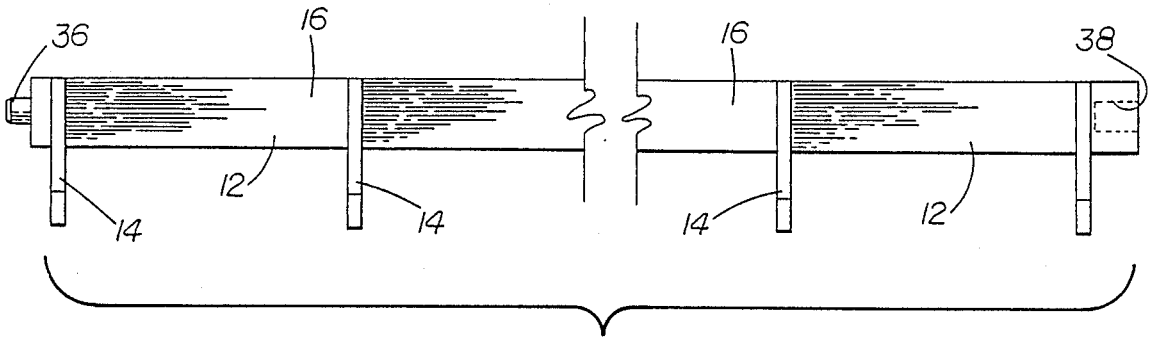
FIG. 4 is a side elevational view of an alternative embodiment of the present invention including a relatively flat upper support surface and cooperating pin and aperture connectors at each end.

In contrast, as best shown by the alternative embodiment in FIG. 4, the upper surface 16 may be substantially horizontal or flat. This may be desired when, for example, a metal beam (not shown) is to be positioned so as to extend across and between bolsters 10 in the same manner as the rebar R shown in FIG. 5. Such a bolster 10 may be utilized in the construction of columns.

The bolster 10 of the present invention also includes an assembly, generally designated by reference numerals 20 and 22, for positively connecting any number of bolsters together in series. As shown in FIG. 1, each bolster includes a male connector 20 at one end and a cooperating female connector 22 at the opposite end. The male connector 20 includes a plate 26 (see also FIGS. 2 and 3). As shown, the plate 26 extends from the end of support member 12 in direct alignment therewith. A pair of opposed locking ridges 28 are provided on the plate 26.

The female connector 22 includes a pair of latching plates 30, 32. The latching plates 30, 32 are provided in parallel and spaced from each other a distance substantially corresponding to the width of the male connector plate 26. Each plate 30, 32 also includes a locking ridge receiving groove 34 formed in the opposing faces of the plates.

Figure 2:
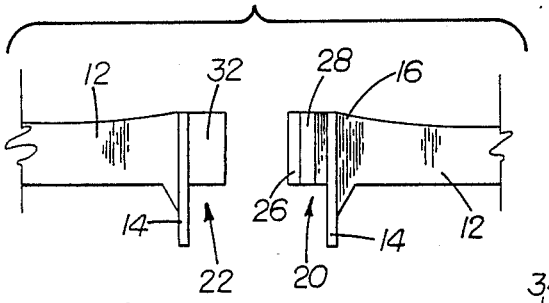
FIG. 2 is a cutaway side elevational view showing the male and female snap lock assembly for connecting bolsters as shown in FIG. 1 together in series.
Figure 3:
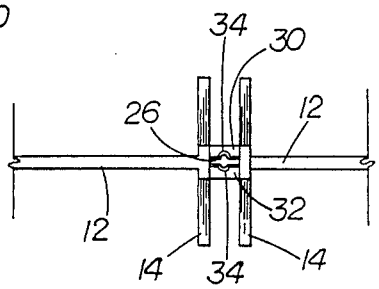
FIG. 3 is a cutaway top plan view of the snap lock assembly shown in FIG. 2 wherein two bolsters have been connected together.

As shown in FIGS. 2 and 3, bolsters 10 may be serially connected together in full alignment by simply plugging the male connector 20 of one bolster into the female connector 22 of another bolster. Latching plates 30, 32 of the female connector 22 are resilient to allow spreading of the latching plates for insertion of the male connector plate 26. When fully inserted, the locking ridges 28 are aligned with and engaged by the grooves 34 in the latching plates 30, 32 (see FIG. 3). Of course, once aligned, the latching plates 30, 32 spring back into their original position to provide positive snap locking action to maintain the bolsters together.

An alternative connection mechanism is shown in the FIG. 4 embodiment. On this bolster 10, the male connector is simply a pin 36 and the female connector, a pin receiving aperture 38. This type of connecting structure does not provide positive locking action as does the structure described above and shown in detail in FIGS. 2 and 3. For certain applications, however, it may be preferred. Of course, other structures could also be utilized for connection depending upon the particular needs and desires of the end user. These are merely being presented as examples and the invention is not intended to be limited to the exact structure shown.

An additional alternative embodiment is shown in FIGS. 6–9. As shown in these figures, the bolster 10 includes an elongated support member 12 that rests on legs 14. As shown, one leg 14 is provided at each distal end of intermittently spaced cross members 15. In addition, one leg 14 is mounted directly to the support member 12 between the cross members 15. An upper support surface 16 of the support member 12 including scallops 18 supports the reinforcing steel or rebar in the manner described above with respect to the embodiments shown in FIGS. 1–5.

Figures 6, 8, 9:
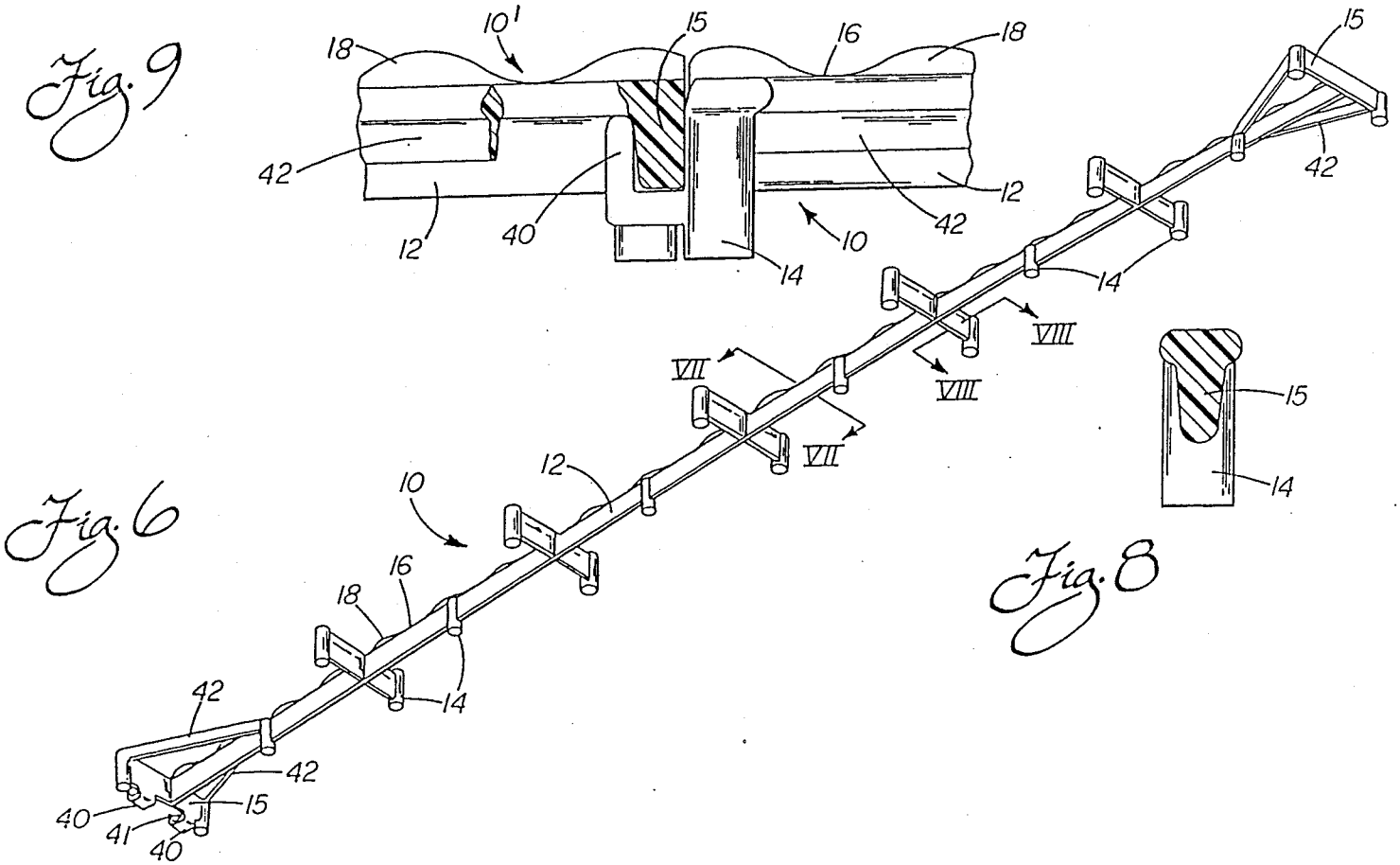
FIG. 6 is a perspective view of an alternative embodiment of the bolster of the present invention.
FIG. 8 is an enlarged cross-sectional view of the bolster shown in FIG. 6 along line VIII—VIII.
FIG. 9 is an enlarged partially sectional, side elevational view showing the connection of two bolsters of FIG. 6 together.

A pair of connecting clips 40 are provided at spaced positions along the cross member 15 at one end of each bolster 10 (see FIGS. 6 and 9). These clips 40 allow two or more bolsters 10 to be connected together in series with the longitudinal axis of each bolster support member 12 substantially aligned. More particularly, as best shown in FIG. 9, each clip 40 is sufficiently resilient to snap over the cross member 15 at the opposite end of an adjacent bolster 10'. Further, the inner faces 41 of the clips 40 abut the support member 12 of the bolster 10' so as to prevent the two bolsters 10, 10' from shifting out of alignment. Thus, the clips 40 serve to positively hold the two bolsters 10, 10' together.

Additional strength is provided to the cross members 15 at the two ends of the bolster 10 that allow connection of multiple bolsters together as described above. More specifically, a diagonally extending support beam 42 connects the legs 14 at the distal ends of the end crossbeams 15 with the support member 12. This adds rigidity to the crossbeams 15 at the ends of the bolster 10 so as to improve the integrity of the structure and the connection between adjacent bolsters.

Figure 7:
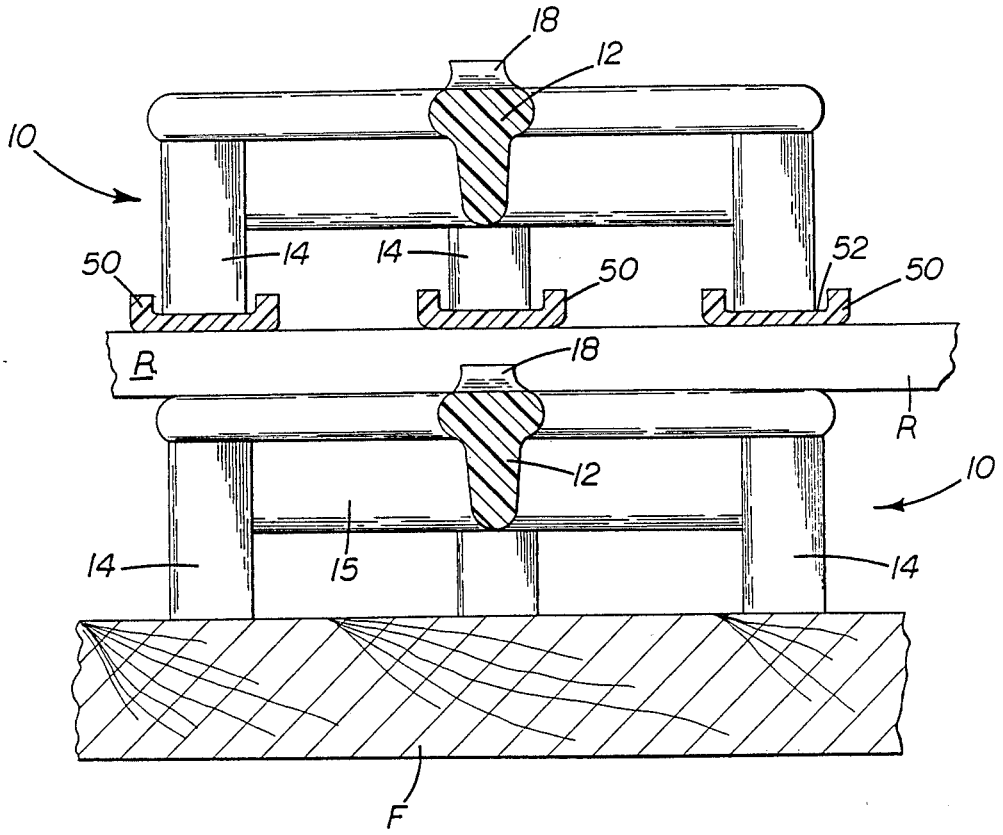
FIG. 7 is an enlarged cross-sectional view of the bolster shown in FIG. 6 along line VII—VII.

As best appreciated from viewing FIGS. 7 and 8, the bolster 10 exclusively includes rounded or radiused corners. By eliminating sharp or square corners from the design, points of stress concentration in the concrete formation both during and following setting are minimized. As a result, stress fractures of the concrete slab are substantially avoided and the overall integrity of the concrete structure is improved.

In accordance with an important aspect of the present invention, the bolster 10 including the support member 12, legs 14 and connecting assembly 20, 22 or clips 40 is constructed of non-biodegradable material. Certain man-made resins exhibiting particular physical properties are preferred.

More specifically, the material should be completely impervious to water in order to prevent the entry of water into the concrete slab through the bolster 10. In addition, the material should be both shatter-resistant and sag-resistant within a temperature range of at least 220° to −40° F. Further, in order to provide the necessary strength to support heavy rebar above the bottom of a form as shown in FIG. 5, the material should be able to support a concentrated load of between 60–400 psi.

Examples of such materials include ABS plastic, polycarbonates, polybutyleneterphalates, polyphenylene oxides and any mixtures thereof. ABS plastic is available from a number of sources including Borg Warner Corporation under the trademark CYCLOAC. Polycarbonates are also available from many sources including, for example, Mobay under the trademark MERLON and from General Electric Corporation under the trademark LEXAN. Also available from General Electric are the plastics Noryl (a polyphenylene oxide), Valox (a polybutylenetephalate) and Xenoy (a polyphenylene oxide and polybutyleneterphalate mixture). Advantageously, utilization of any of these resins allows the simple and relatively inexpensive injection molding of the bolster 10 in one strong, lightweight piece.

In use such as in the construction of a roadway bridge, bolsters 10 are connected together end-to-end as required and positioned at desired spacing within a form F (see FIG. 5). Rebar R of desired strength is then placed onto the upper surfaces 16 of the support members 12 so that the rebar extends between and across the bolsters 10. During this positioning, the bolsters 10 are maintained in an upright position by the legs 14 that resist tipping of the bolsters onto their sides. In addition, the lateral spacing of the rebar is assured by the sloping surface of the scallops 18. Where a second layer of rebar is desired, a series of strip-type platforms or runners 50 are provided at spaced locations across the top of the rebar R (see also FIG. 7). These runners 50 include a central groove 52 in which the legs 14 of the next layer of bolsters or uppers 10 are received and held. Rebar may then be positioned between these bolsters 10 so as to provide two tiers of rebar in the formation.

Once all the rebar R is in position, concrete is added to the form F. The concrete flows under and completely around the rebar R and encases the bolsters 10. After the concrete sets, the form F is removed. This, of course, leaves the bottom surface of the legs 14 of the bolsters 10 exposed to the elements.

Since the bolsters 10 are constructed of non-biodegradable material, they do not corrode or rust and therefore maintain their full integrity over time. In addition, bolsters 10 constructed in accordance with the present invention are water resistant. Thus, water cannot seep deep into the concrete slab through the bolsters 10. Further, it should be appreciated that the bolster 10 is constructed from material that bonds with the concrete to form a substantially watertight seal. Thus, the possibility of water leaking or being drawn by capillary action, into the concrete slab along the interface between the bolster and the concrete is greatly reduced or eliminated. As a result, the problem of spalling from either rusting or freezing is substantially overcome.

In summary, numerous benefits have been described which result from employing the concepts of the present invention. The bolster 10 is constructed of a non-biodegradable material so as to resist corrosion and rusting. The bolster may be constructed from man-made resin allowing relatively inexpensive production by means of injection molding. Preferably, the bolster material is impervious to water and forms a bond with the concrete so as to virtually eliminate any possibility of water seeping into the slab and causing any significant spalling problems.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted with the breadth to which they are fairly, legally and equitably entitled.

I claim:

1. A bolster for supporting reinforcing steel such as beams and rebar in concrete during pouring and setting of said concrete, comprising:

an elongated support member having a surface for supporting said reinforcing steel and leg means for holding said support member in an upright position; said support member and leg means being constructed from a non-biodegradable material; said bolster further including first and second cross members at opposite ends of said bolster as well as means for positively connecting bolsters together in series, said connecting means including a resilient connecting clip mounted to said first cross member at one end of said bolster, said clip being sufficiently resilient to snap over and engage a second cross member of an adjacent bolster.

2. The bolster set forth in claim 1, wherein said leg means extends substantially perpendicular to said elongated support member.

3. The bolster set forth in claim 1, wherein said connecting means includes a male connector at one end of said bolster and a cooperating female connector at a second, opposite end.

4. The bolster set forth in claim 3, wherein said male connector is a plate including oppositely disposed locking ridges.

5. The bolster set forth in claim 3, wherein said female connector is two spaced apart, substantially parallel latching plates, each latching plate including a ridge engaging groove.

6. The bolster set forth in claim 3, wherein said male connector is a pin.

7. The bolster set forth in claim 3, wherein said female connector is a pin receiving aperture formed in an end wall of said support member.

8. The bolster set forth in claim 1, wherein said reinforcing steel support surface of said support member is scalloped to support rebar and hold said rebar in position.

9. The bolster set forth in claim 1, wherein said non-biodegradable material is impervious to water.

10. The bolster set forth in claim 1, wherein said non-biodegradable material is shatter resistant and sag resistant within a temperature range of between 220 and −40 degrees fahrenheit.

11. The bolster set forth in claim 2, wherein said non-biodegradable material is capable of supporting a concentrated load of between 60 and 400 psi.

12. The bolster set forth in claim 3, wherein said non-biodegradable material has a flex modulus of between 200,000 and 1,500,000.

13. The bolster set forth in claim 4, wherein said non-biodegradable material bonds with concrete so as to substantially prevent water from entering the interface between the bolster and the concrete.

14. The bolster set forth in claim 1, wherein said non-biodegradable material is a man-made resin.

15. The bolster set forth in claim 1, wherein said support member is substantially T-shaped in cross-section.

16. The bolster set forth in claim 1, further comprising a diagonally extending support beam that connects a distal end of said first and second cross members to said elongated support member so as to increase the rigidity of said cross members.

17. The bolster set forth in claim 16, wherein both said cross members and said support beams are substantially T-shaped in cross section.

* * * * *